US008685310B2

(12) United States Patent
Kim et al.

(10) Patent No.: US 8,685,310 B2
(45) **Date of Patent: *Apr. 1, 2014**

(54) METHOD OF PREPARING NANOFIBERS VIA ELECTRO-BLOWN SPINNING

(75) Inventors: Yong Min Kim, Kyeonggi-do (KR); Young Bin Sung, Kyeonggi-do (KR); Rai Sang Jang, Kyeonggi-do (KR); Kyoung Ryoul Ahn, Kyeonggi-do (KR)

(73) Assignees: E I du Pont de Nemours and Company, Wilmington, DE (US); Nano Technics Company Ltd

( * ) Notice: Subject to any disclaimer, the term of this patent is extended or adjusted under 35 U.S.C. 154(b) by 10 days.

This patent is subject to a terminal disclaimer.

(21) Appl. No.: 13/470,579

(22) Filed: May 14, 2012

(65) Prior Publication Data

US 2012/0256355 A1 Oct. 11, 2012

Related U.S. Application Data

(60) Continuation of application No. 12/568,026, filed on Sep. 28, 2009, now Pat. No. 8,178,029, which is a continuation of application No. 10/477,882, filed as application No. PCT/KR02/02165 on Nov. 20, 2002, now Pat. No. 7,618,579, application No. 13/470,579, which is a continuation of application No. 12/548,732, filed on Aug. 27, 2009, which is a division of application No. 10/477,882, filed on Nov. 19, 2003, now Pat. No. 7,618,579.

(30) Foreign Application Priority Data

Mar. 26, 2002 (KR) ..... 10-2002-0016489

(51) Int. Cl.
*D06M 10/00* (2006.01)
*H05B 7/00* (2006.01)

(52) U.S. Cl.
USPC ..... 264/465

(58) Field of Classification Search
USPC ..... 264/464, 465, 466, 484
See application file for complete search history.

(56) References Cited

U.S. PATENT DOCUMENTS 705,691 A 7/1902 Morton
2,048,651 A 7/1936 Norton (Continued)

FOREIGN PATENT DOCUMENTS

EP 0674035 9/1995
JP 6306755 11/1994

(Continued)

OTHER PUBLICATIONS

U.S. Appl. No. 12/548,732—Non Final Rejection issued Jun. 23, 2010.

(Continued)

*Primary Examiner* — Leo B Tentoni

(57) ABSTRACT

The invention relates to a nanofiber web preparing apparatus and method via electro-blown spinning. The nanofiber web preparing method includes feeding a polymer solution, which is a polymer dissolved into a given solvent, toward a spinning nozzle, discharging the polymer solution via the spinning nozzle, which is charged with a high voltage, while injecting compressed air via the lower end of the spinning nozzle, and collecting fiber spun in the form of a web on a grounded suction collector under the spinning nozzle, in which both of thermoplastic and thermosetting resins are applicable, the solution does not need to be heated and electrical insulation is readily realized.

8 Claims, 4 Drawing Sheets

(56) References Cited

U.S. PATENT DOCUMENTS

| | | | |
|---|---|---|---|
| 2,168,027 | A | 8/1939 | Gladding |
| 2,810,426 | A | 10/1957 | Till et al. |
| 3,825,380 | A | 7/1974 | Harding et al. |
| 4,011,067 | A | 3/1977 | Carey, Jr. |
| 4,472,329 | A | 9/1984 | Muschelknautz et al. |
| 5,122,048 | A | 6/1992 | Deeds |
| 5,407,619 | A | 4/1995 | Maeda et al. |
| 6,110,590 | A | 8/2000 | Zarkoob et al. |
| 6,267,575 | B1 | 7/2001 | Rooyakkers et al. |
| 6,308,509 | B1 | 10/2001 | Scardino et al. |
| 6,520,425 | B1 | 2/2003 | Reneker |
| 6,554,881 | B1 | 4/2003 | Healey |
| 6,604,925 | B1 | 8/2003 | Dubson |
| 6,616,435 | B2 | 9/2003 | Lee et al. |
| 7,618,579 | B2 | 11/2009 | Kim et al. |
| 8,178,029 | B2 | 5/2012 | Kim et al. |
| 2002/0042128 | A1 | 4/2002 | Bowlin et al. |
| 2002/0089094 | A1 | 7/2002 | Kleinmeyer et al. |
| 2002/0100725 | A1 | 8/2002 | Lee et al. |
| 2002/0122840 | A1 | 9/2002 | Lee et al. |
| 2003/0137069 | A1 | 7/2003 | Reneker |
| 2005/0073075 | A1 | 4/2005 | Chu |
| 2007/0018361 | A1 | 1/2007 | Xu |

FOREIGN PATENT DOCUMENTS

| | | | |
|---|---|---|---|
| WO | WO 00/22207 | | 4/2000 |
| WO | WO 01/54667 | | 8/2001 |
| WO | WO 03/004735 | A1 | 1/2003 |
| WO | WO2005/090653 | A1 | 9/2005 |

OTHER PUBLICATIONS

U.S. Appl. No. 12/548,732—Applicants reply mailed Dec. 21, 2010.
U.S. Appl. No. 12/548,732—Final Rejection issued Mar. 21, 2011.
U.S. Appl. No. 12/548,732—Applicants reply mailed Sep. 21, 2011.
U.S. Appl. No. 12/548,732—NonFinal Rejection issued Oct. 11, 2011.
U.S. Appl. No. 12/548,732—Applicants reply mailed Feb. 13, 2012.
U.S. Appl. No. 12/548,732—Final Rejection issued Jun. 21, 2012.
U.S. Appl. No. 12/568,026—Non Final Rejection issued Jul. 1, 2010.
U.S. Appl. No. 12/568,026—Applicants reply mailed Jan. 3, 2011.
U.S. Appl. No. 12/568,026—Non Final Rejection issued Feb. 24, 2011.
U.S. Appl. No. 12/568,026—Applicants reply mailed Aug. 24, 2011.
U.S. Appl. No. 12/568,026—Final Rejection issued Oct. 21, 2011.
U.S. Appl. No. 12/568,026—Applicants reply mailed Nov. 9, 2011.
U.S. Appl. No. 12/568,026—Applicants reply mailed Dec. 6, 2011.
U.S. Appl. No. 10/477,882—NonFinal Rejection issued Jun. 21, 2006.
U.S. Appl. No. 10/477,882—Applicants reply mailed Aug. 1, 2006.
U.S. Appl. No. 10/477,882—Final Rejection issued Oct. 18, 2006.
U.S. Appl. No. 10/477,882—Applicants reply mailed Jan. 17, 2007.
U.S. Appl. No. 10/477,882—NonFinal Rejection issued Feb. 20, 2007.
U.S. Appl. No. 10/477,882—Applicants reply mailed May 14, 2007.
U.S. Appl. No. 10/477,882—Final Rejection issued Jul. 27, 2007.
U.S. Appl. No. 10/477,882—Applicants reply mailed Oct. 15, 2007.
U.S. Appl. No. 10/477,882—pre-Brief Conference Request, Feb. 20, 2008.
U.S. Appl. No. 10/477,882—pre-Brief Decision, Jul. 21, 2008.
U.S. Appl. No. 10/477,882—NonFinal Rejection issued Oct. 2, 2008.
U.S. Appl. No. 10/477,882—Applicants reply mailed Apr. 2, 2009.
U.S. Appl. No. 10/477,882—Final Rejection issued Jun. 23, 2009.
U.S. Appl. No. 10/477,882—Applicants reply mailed Aug. 14, 2009.
Chun Iksoo, Fine Fibers Spun by Electrospinning Process from Polymer Solutions and Polymer Melts in Air and Vacuum: Ph.D. Dissertation, The University of Akron, 1995.
Srinivasan, Gokul, Structure and Morpholgy of Electrspun Polymer Fibers, Ph.D. Dissertation, The University of Akron, 1994.
Doshi, Jayesh and Darrell H Reneker, Electrospinning Process and Applications of Electrspun Fibers, J of Electrostatis vol. 35(1995)p. 151-160.
Fong, Hao,The study of Electrospinning and the Physical Properties of Electrspun Nanofiberts, Disseratioan for the Degree of Doctor of Philosphy, University of Akron 1999.
Kenawy, E.R.Release of tetracycline hydrochloride fromelectrspun poly(ethylene-co-vinyl acetate),Poly(lactic acid),and a blend, J of Controlled Release,vol. 81 (2002),pp. 57-64.
Reneker D.H and I Chun, Nonometrea diamer fibres of plymer, produced by electrospinning, Nanotechnology vol. 7 (1996) pp. 216-223.
Abstract, Lee., et. al., Nanofiber Formation of Poly(etherimide) under Various Electrospining Conditions, Journal of the Korean Fiber Society, 2002, pp. 1-13, vol. 39, No. 1.
Srinivasan, Gokul; Reneker, Darrell; Structure and Morpholgy of Small Diameter Electrospun Aramid Fibers, Polymer International, vol. 36 (1995) pp. 195-201.

METHOD OF PREPARING NANOFIBERS VIA ELECTRO-BLOWN SPINNING

PRIORITY INFORMATION

This application claims priority to U.S. application Ser. No. 12/568,026 filed on Sep. 28, 2009 and now U.S. Pat. No. 8,178,029; which claimed priority to U.S. application Ser. No. 10/477,882 which had a 35 USC 371 date of Nov. 19, 2003 and now U.S. Pat. No. 7,618,579; which claimed priority to a PCT application filed on Nov. 20, 2002 and published as PCT/KR02/02165, and Korean patent KR 10-2002-0016489 filed May 26, 2002.

The present invention relates to a nanofiber web preparing apparatus and method via electro-blown spinning, in particular, in which both of thermoplastic and thermosetting resins are applicable, such that the polymer solution does not need to be heated and electrical insulation is readily realized. Herein, "electro-blown" means injecting compressed air while applying a high voltage during spinning of nanofiber, and "electro-blown spinning" means spinning using an electro-blown method.

In general, consumption of non-woven cloth is gradually increasing owing to various applications of non-woven cloth, and manufacturing processes of non-woven cloth are also variously developing.

A variety of studies have been carried out in many countries including the USA for developing technologies for manufacturing non-woven cloth composed of ultra-fine nanofiber (hereinafter it will be referred to as 'nanofiber web') which is advanced for one stage over conventional super-fine fiber. Such technologies are still in their initial stage without any commercialization while conventional technologies remain in a stage in which super-fine fibers are prepared with a diameter of about several micrometer. Nanofiber having a diameter of about several nanometer to hundreds of nanometer cannot be prepared according to conventional super-fine fiber technologies. Nanofiber has a surface area per unit volume, which is incomparably larger than that of conventional super-fine fiber. Nanofiber having various surface characteristics, structures and combined components can be prepared so as to overcome the limitations of physical properties of articles made of conventional super-fine fiber while creating articles having new performance.

It is well known that a nanofiber web using the above nanofiber preparing method can be used as an ultra precise filter, electric-electronic industrial material, medical biomaterial, high-performance composite, etc.

The technologies in use for preparing ultra-fine fiber up to the present can be classified into three methods: flash spinning, electrostatic spinning and meltblown spinning. Such technologies are disclosed in Korean Laid-Open Patent Application Serial Nos. 10-2001-31586 and 10-2001-31587, entitled "Preparing Method of Ultra-Fine Single Fiber" previously filed by the assignee.

Korean Laid-Open Patent Application Serial No. 10-2001-31586 discloses that nanofiber in nanometer scale can be mass-produced with high productivity and yield by systematically combining melt-blown spinning and electrostatic spinning. FIG. 3 schematically shows a process for explaining this technology. Referring to FIG. 3, a thermoplastic polymer is fed via a hopper 10 into an extruder 12 where the thermoplastic polymer is melted into a liquid polymer. The molten liquid polymer is fed into a spinneret 14 and then spun via a spinning nozzle 16 together with hot air into an electric field. An electric field is generated between the spinning nozzle 16 charged with voltage and a collector 18. Nanofibers spun onto the collector 18 are collected in the form of a web by a vacuum blower 20.

Korean Laid-Open Patent Application Serial No. 10-2001-31587 discloses that nanofiber in nanometer scale can be mass-produced with high productivity and yield by systematically combining flash spinning and electrostatic spinning. FIG. 4 schematically shows a process for explaining this technology. Referring to FIG. 4, a polymer solution is fed from a storage tank 22 into a spinneret 26 with a compression pump 24, and spun into an electric field via a decompressing orifice 28 and then via a spinning nozzle 30. An electric field is generated between the spinning nozzle 30 charged with voltage and a collector 32. Nanofibers spun onto the collector 32 are collected in the form of a web by a vacuum blower 34.

It can be understood that the nanofiber webs composed of nanofiber can be prepared according to the two technologies as above.

However, the foregoing conventional technologies have many drawbacks in that electrical insulation is not readily realized, applicable resin is restricted and heating is needed.

SUMMARY OF INVENTION

The present invention has been made to solve the foregoing problems and it is therefore an object of the present invention to provide a nanofiber web preparing method in which both of thermoplastic and thermosetting resins are applicable, such that a polymer solution does not need to be heated and electrical insulation is readily realized.

It is another object of the invention to provide a nanofiber web preparing apparatus for conducting the above preparing method.

According to an aspect of the invention to obtain the above objects, it is provided a nanofiber web preparing method comprising the following steps of feeding a polymer solution, which is dissolved into a given solvent, to a spinning nozzle; discharging the polymer solution through the spinning nozzle, which is charged with a high voltage, while injecting compressed air via the lower end of the spinning nozzle; and collecting fiber spun in the form of a web on a grounded vacuum collector under the spinning nozzle.

According to another aspect of the invention to obtain the above objects, it is provided a nanofiber web preparing apparatus comprising a storage tank for preparing a polymer solution; a spinning nozzle for discharging the polymer solution fed from the storage tank; an air nozzle disposed adjacent to the lower end of the spinning nozzle for injecting compressed air; high voltage charging means connected to the spinning nozzle; and a grounded collector for collecting spun fiber in the form of a web which is discharged from the spinning nozzle.

DETAILED DESCRIPTION

Figure 1:
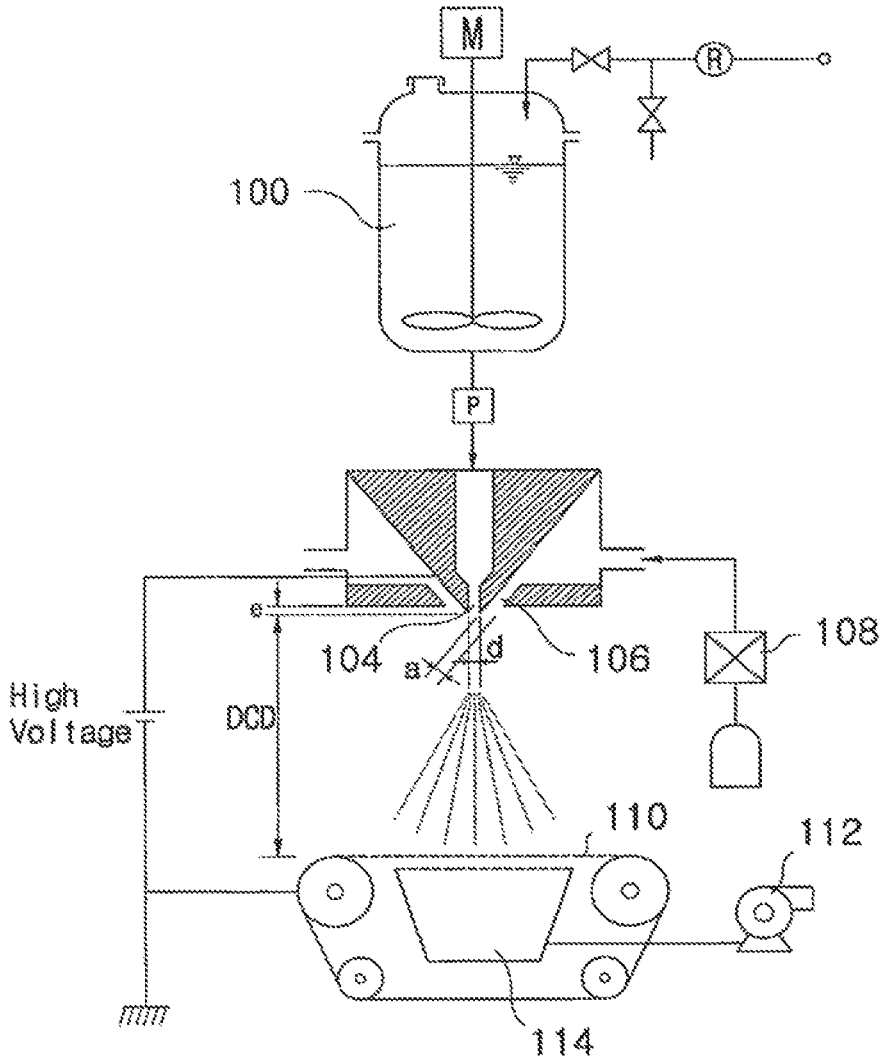
FIG. 1 shows a construction of a nanofiber web preparing apparatus of the invention.
Figure 2A:
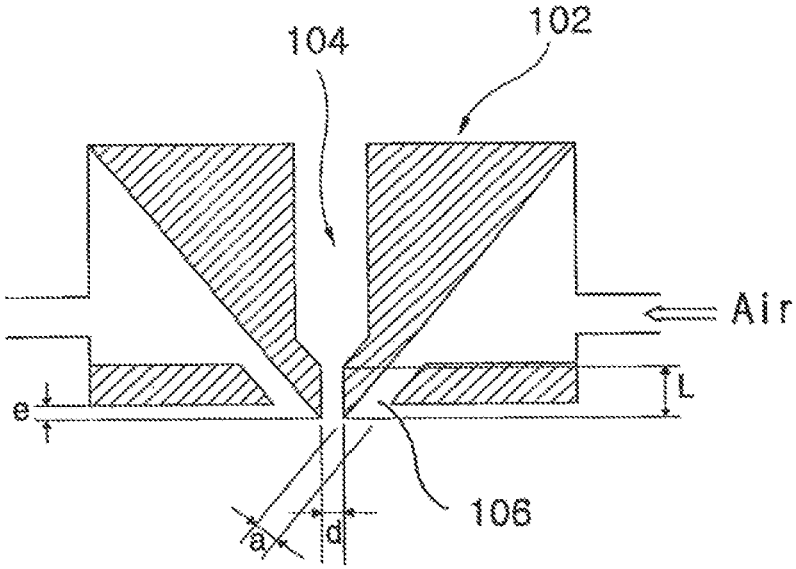
FIG. 2A is a sectional view of a spinneret having an air nozzle on a knife edge.
Figure 2B:
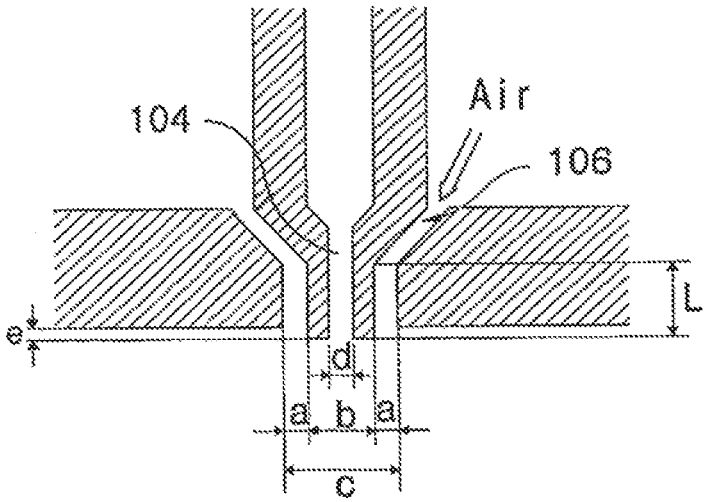
FIG. 2B is a sectional view of another spinneret having a cylindrical air nozzle.
Figure 3:
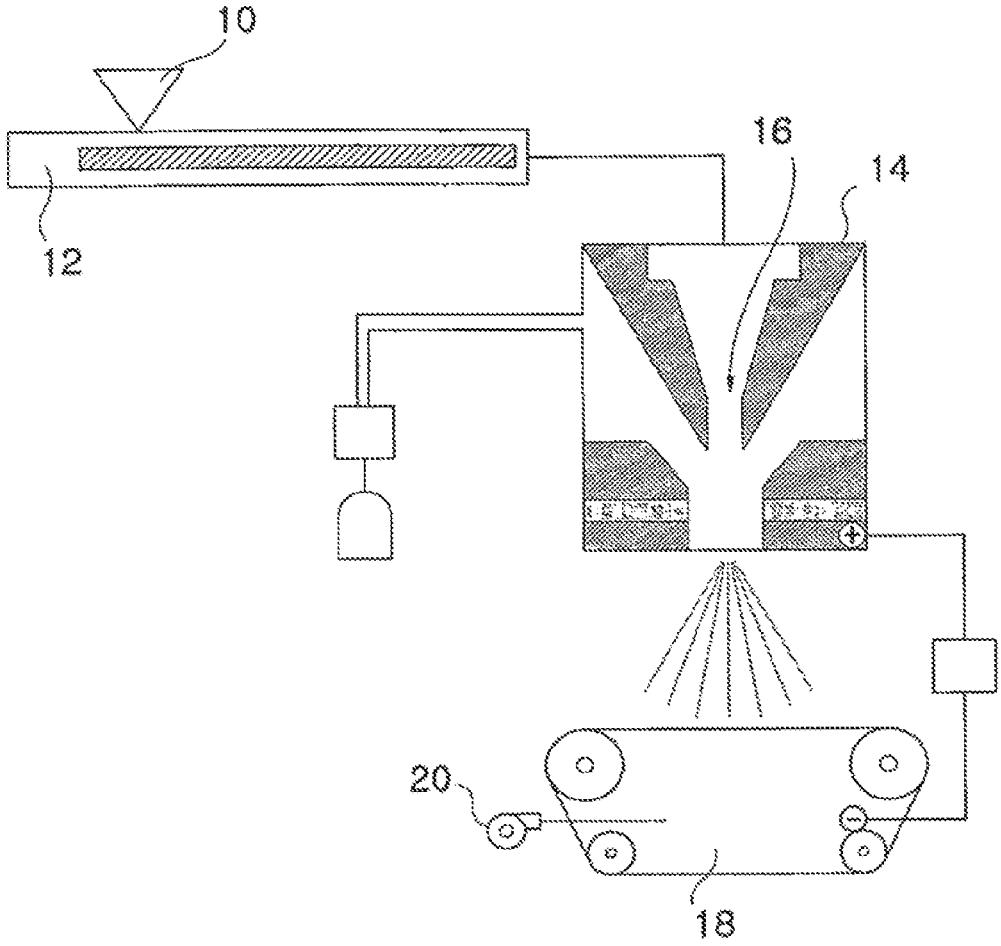
FIG. 3 schematically shows a nanofiber preparing process via systematic combination of melt-blown spinning and electro-blown spinning.
Figure 4:
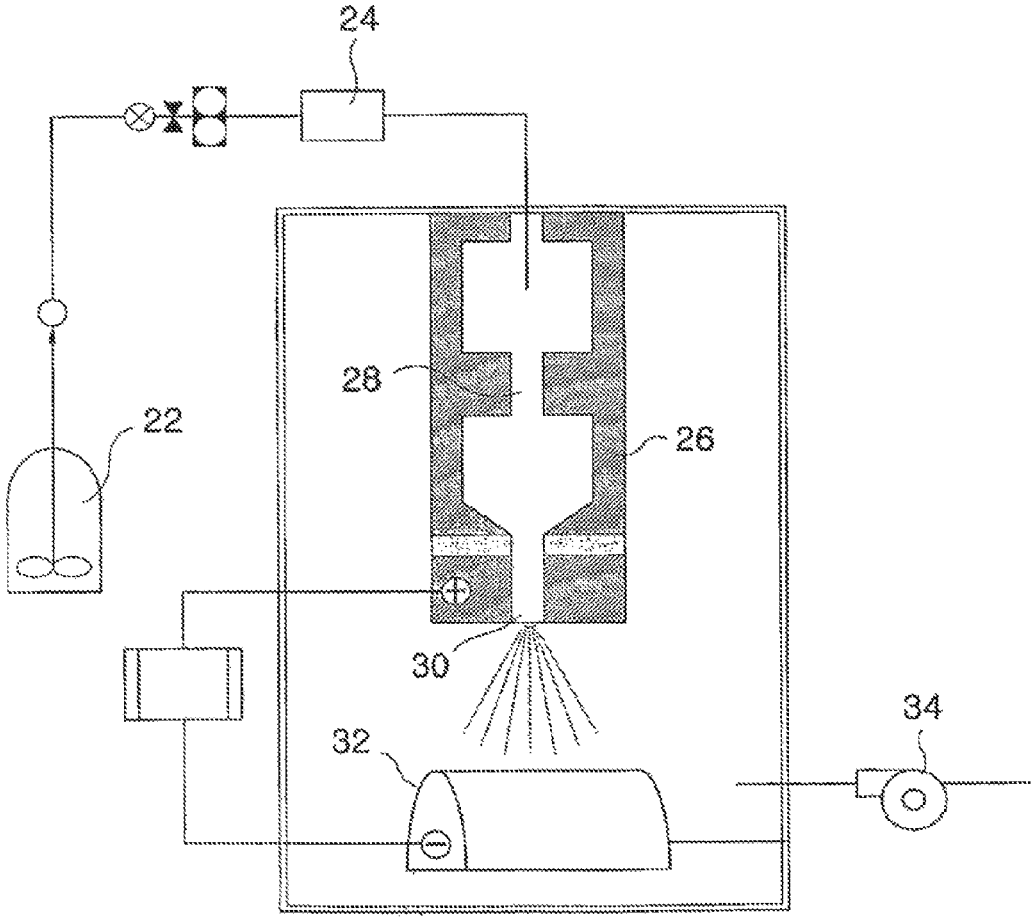
FIG. 4 schematically shows a nanofiber preparing process via systematic combination of flash spinning and electrostatic spinning.

FIG. 1 shows a construction of a nanofiber web preparing apparatus of the invention for illustrating a nanofiber web preparing process, and FIGS. 2A and 2B show nozzle constructions for illustrating spinning nozzles and air nozzles. The nanofiber web preparing process will be described in detail in reference to FIGS. 1 to 2B.

A storage tank 100 prepares a polymer solution via combination between polymer and solvent. Polymers available for the invention are not restricted to thermoplastic resins, but may utilize most synthetic resins, including thermosetting resins. Examples of the suitable polymers may include polyimide, nylon, polyaramide, polybenzimidazole, polyetherimide, polyacrylonitrile, PET (polyethylene terephthalate), polypropylene, polyaniline, polyethylene oxide, PEN (polyethylene naphthalate), PBT (polybutylene terephthalate), SBR (styrene butadiene rubber), polystyrene, PVC (polyvinyl chloride), polyvinyl alcohol, PVDF (polyvinylidene fluoride), polyvinyl butylene and copolymers or derivative compounds thereof. The polymer solution is prepared by selecting a solvent according to the above polymers. Although the apparatus shown in FIG. 1 adopts a compression arrangement which forcibly blows compressed air or nitrogen gas into the storage tank 100 in order to feed the polymer solution from the storage tank 100, any known means can be utilized without restricting feed of the polymer solution. The polymer solution can be mixed with additives including any resin compatible with an associated polymer, plasticizer, ultraviolet ray stabilizer, crosslink agent, curing agent, reaction initiator and etc. Although dissolving most of the polymers may not require any specific temperature ranges, heating may be needed for assisting the dissolution reaction.

The polymer solution is discharged from the storage tank 100 through a spinning nozzle 104 of a spinneret 102 which is electrically insulated and charged with a high voltage. After heating in an air heater 108, compressed air is injected through air nozzles 106 disposed on either side of the spinning nozzle 104.

Now reference will be made to FIGS. 2A and 2B each illustrating the construction of the spinning nozzle 104 and the air nozzle 106 in the spinneret 102. FIG. 2A shows the same construction as in FIG. 1 in which the air nozzle 106 is formed by a knife edge on both sides of the spinning nozzle 104. In the spinning nozzle 104 shown in FIG. 2A, the polymer solution flows into the spinning nozzle 104 through an upper portion thereof and is injected through a capillary tube in the lower end. Since a number of spinning nozzles 104 of the above construction are arranged in a line at given intervals, air nozzles 106 may be formed by knife edges at both sides of the spinning nozzles 104 parallel to the arrangement thereof, and nanofibers can be advantageously spun with the number of spinning nozzles 104. Referring to preferred magnitudes of the components, the air nozzles 106 each have an air gap "a" which is suitably sized in the range of about 0.1 to 5 mm and preferably of about 0.5 to 2 mm, whereas the lower end capillary tube has a diameter "d" which is suitably sized with in the range of about 0.1 to 2.0 mm and preferably of about 0.2 to 0.5 mm. The lower end capillary tube of the air nozzle 106 has a suitable length-to-diameter ratio L/d, which is in the range of about 1 to 20 and preferably about 2 to 10. A nozzle projection "e" has a length corresponding to the difference between the lower end of air nozzle 106 and the lower end of spinning nozzle 104, and functions to prevention fouling of the spinning nozzle 104. The length of the nozzle projection "e" is preferably about −5 to 10 mm, and more particularly 0 to 10 mm.

The spinning nozzle 104 shown in FIG. 2B has a construction which is substantially equivalent to that shown in FIG. 2A, while the air nozzle 106 has a cylindrical structure circularly surrounding the spinning nozzle 104, in which compressed air is uniformly injected from the air nozzle 106 around nanofibers, which is spun through the spinning nozzle 104, so as to have an advantageous orientation over the construction of FIG. 2A, i.e. the air nozzles formed by the knife edge. Where a number of spinning nozzles 104 are necessary, spinning nozzles 104 and air nozzles 106 of the above construction are arranged within the spinneret. However, a manufacturing process of this arrangement is more difficult than that in FIG. 2A.

Now referring to FIG. 1 again, the polymer solution discharged from the spinning nozzle 104 of the spinneret 102 is collected in the form of a web on a vacuum collector 110 under the spinning nozzle 104. The collector 110 is grounded, and designed to draw air through an air collecting tube 114 so that air can be drawn through a high voltage region between the spinning nozzle 104 and the collector 110 and the suction side of a blower 112. Air drawn in by the blower contains solvent and thus a Solvent Recovery System (SRS, not shown) is preferably designed to recover solvent while recycling air through the same. The SRS may adopt a well-known construction.

In the above construction for the preparing process, portions to which voltage is applied or which are grounded are obviously divided from other portions so that electrical insulation is readily realized.

The invention injects compressed air through the air nozzle 106 while drawing air through the collector 110 so that nozzle fouling can be minimized in an optimum embodiment of the invention. As not apparently described in the above, nozzle fouling acts as a severe obstructive factor in preparation processes via spinning except for melt-blown spinning. The invention can minimize nozzle fouling via compressed air injection and vacuum. The nozzle projection "e" more preferably functions to clean nozzle fouling since compressed air injected owing to adjustment of the nozzle projection "e" can clean the nozzles.

Further, various substrates can be arranged on the collector to collect and combine a fiber web spun on the substrate so that the combined fiber web can be used as a high-performance filter, wiper and so on. Examples of the substrate may include various non-woven cloths such as melt-blown non-woven cloth, needle punched and spunlaced non-woven cloth, woven cloth, knitted cloth, paper and the like, and can be used without limitations so long as a nanofiber layer can be added on the substrate.

The invention has the following process conditions.

Voltage is applied to the spinneret 102 preferably in the range of about 1 to 300 kV and more preferably of about 10 to 100 kV with a conventional high voltage charging means. The polymer solution can be discharged in a pressure ranging from about 0.01 to 200 kg/cm$^2$ and in preferably about 0.1 to 20 kg/cm$^2$. This allows the polymer solution to be discharged in large quantities adequate for mass production of nanofibers. The process of the invention can discharge the polymer solution with a high throughput rate of about 0.1 to 5 cc/min hole as compared with electrostatic spinning methods.

Compressed air injected via the air nozzle 106 has a flow rate of about 10 to 10,000 m/min and preferably of about 100 to 3,000 m/min. Air temperature is preferably in the range of about room temperature to about 300° C. and more preferably between about 100° C. and room temperature. A Die to Collector Distance (DCD), i.e. the distance between the lower end of the spinning nozzle 104 and the vacuum collector 110, is preferably about 1 to 200 cm and more preferably 10 to 50 cm.

Hereinafter the present invention will be described in more detail in the following examples.

A polymer solution having a concentration of 20 wt % was prepared using polyacrylonitrile (PAN) as a polymer and DMF as a solvent and then spun through a spinneret having knife edge air nozzles as shown in FIG. 1. The polymer solution was spun according to the following condition, in which a spinning nozzle had a diameter of about 0.25 mm, L/d of the nozzle was 10, DCD was 200 mm, a spinning pressure was 6 kg/cm$^2$ and an applied voltage was 50 kV DC.

The spinneret on the knife edge constructed as in FIG. 1 was used in the following examples. The diameter of the spinning nozzle was 0.25 mm, L/d of the nozzle was 10, and DCD was varied in examples 1 to 3 and set to 300 mm in examples 4 to 10. The number of the spinning nozzles was 500, the width of a die was 750 mm, the nozzle projection "e" was about 0 to 3 mm, and the flow rate of compressed air was maintained at 300 to 3,000 m/min through the air nozzle.

TABLE 1

| No. | Polymer | Solvent | Conc. (%) | DCD (mm) | Spinning Pressure (kgf/cm2) | App. Voltage (kV) |
|---|---|---|---|---|---|---|
| Ex. 1 | PAN | DMF | 15 | 350 | 3 | 30 |
| Ex. 2 | PAN | DMF | 20 | 160 | 4 | 40 |
| Ex. 3 | PAN | DMF | 20 | 200 | 6 | 50 |
| Comp. Ex. 1 | PAN | DMF | 25 | | | |

Example 1 was good in fluidity and spinning ability, but poor in formation of web. Examples 2 and 3 were good in fluidity, spinning ability and formation of web. Examination of SEM pictures showed fiber diameter distribution of about 500 nm to 2 μm. In particular, Example 3 demonstrated uniform fiber diameter distribution in the range of 500 nm to 1.2 μm. In Comparative Example 1, it was difficult to prepare a PAN 25% solution and thus no result was obtained.

TABLE 2

| No. | Spinning Pressure (kgf/cm$^2$) | App. Voltage (kV) | Diam. Distribution (nm) |
|---|---|---|---|
| Ex. 4 | 3 | 21 | 933.96-1470 |
| Ex. 5 | 3 | 30 | 588.69-1000 |
| Ex. 6 | 2.9 | 40 | 500.9-970.8 |
| Ex. 7 | 3 | 60 | 397.97-520.85 |
| Ex. 8 | 3.1 | 80 | 280.01-831.60 |
| Ex. 9 | 3.5 | 40 | 588.69-933.77 |
| Ex. 10 | 4 | 40 | 633.9-1510 |

Table 2 reports conditions and their results of Examples 4 to 10, which used nylon 6,6 for polymer and formic acid for solvent. The polymer solution concentrations were 25%. Fiber diameter distributions in Table 2 were determined by SEM picture examination, in which nanofibers having uniform diameters are irregularly arranged in the form of a web.

As set forth above, the present invention forms webs of nanofibers with a fiber fineness ranging from about several nanometers to hundreds of nanometers. Also the preparing process of the invention has a higher throughput rate compared to conventional electrostatic spinning, thereby potentially mass producing nanofibers. Further, since a polymer solution is used, the invention has advantages in that the necessity of heating polymer is reduced and both thermoplastic and thermosetting resins can be used.

Moreover, in the arrangement used for the electro-blown spinning, the spinneret can be readily electrically insulated while solvent can be recovered via vacuum.

What is claimed is:

1. A nanofiber web preparing method comprising the following steps of:

feeding a polymer solution, which is dissolved into a given solvent, to a spinning nozzle;

discharging the polymer solution via the spinning nozzle, which is applied with a high voltage, while injecting compressed air via the lower end of the spinning nozzle; and spinning the polymer solution on a grounded suction collector under the spinning nozzle.

2. The nanofiber web preparing method as claimed in claim 1, wherein the high voltage applied to the spinning nozzle is about 1 to 300 kV.

3. The nanofiber web preparing method as claimed in claim 1, wherein the polymer solution is compressively discharged through the spinning nozzle under a discharge pressure in the range of about 0.01 to 200 kg/cm$^2$.

4. The nanofiber web preparing method as claimed in claim 1, wherein the compressed air has a flow rate of about 10 to 10,000 m/min and a temperature of about room temperature to 300° C.

5. The nanofiber web preparing method as claimed in claim 4, wherein the compressed air has a temperature ranging from a room temperature to 300° C.

6. The nanofiber web preparing method as claimed in claim 1, further comprising the step of collecting fiber in the form of a web from the polymer solution spun on the collector.

7. The nanofiber web preparing method as claimed in claim 1, wherein the collector has a substrate disposed thereon for collecting the fiber spun in the form of a web on the substrate.

8. The nanofiber web preparing method as claimed in claim 1, wherein the polymer is one selected from a group including polyimide, nylon, polyaramide, polybenzimidazole, polyetherimide, polyacrylonitrile, PET (polyethylene terephthalate), polypropylene, polyaniline, polyethylene oxide, PEN (polyethylene naphthalate), PBT (polybutylene terephthalate), SBR (styrene butadiene rubber), polystyrene, PVC (polyvinyl chloride), polyvinyl alcohol, PVDF (polyvinylidene fluoride), polyvinyl butylene and copolymers or derivative compounds thereof.

* * * * *